US005111888A

United States Patent [19]

Wimmer

[11] Patent Number: 5,111,888

[45] Date of Patent: May 12, 1992

[54] HAMMER-SWINGING MECHANISM

[76] Inventor: Alois Wimmer, Gitzen 85, A-5322 Hof b.Salzburg, Salzburg, Austria

[21] Appl. No.: 465,095

[22] PCT Filed: May 18, 1989

[86] PCT No.: PCT/AT89/00050

§ 371 Date: Jan. 26, 1990

§ 102(e) Date: Jan. 26, 1990

[87] PCT Pub. No.: WO89/11568

PCT Pub. Date: Nov. 30, 1989

[30] Foreign Application Priority Data

May 20, 1988 [AT] Austria ..... A1327/88

[51] Int. Cl.[5] ..... E21C 11/00; B25D 17/28

[52] U.S. Cl. ..... 173/42; 173/185

[58] Field of Search ..... 173/28, 39, 42, 43, 173/44, 45, 81, 22, 96

[56] References Cited

U.S. PATENT DOCUMENTS

| | | | |
|---|---|---|---|
| 1,477,749 | 12/1923 | Dobson | 173/39 |
| 2,174,415 | 9/1939 | Curtis | 173/42 |
| 2,660,110 | 11/1953 | Boutwell | 173/39 |
| 3,327,789 | 6/1967 | Furuseth | 173/42 |
| 3,596,997 | 8/1971 | Valantis . | |
| 3,889,762 | 6/1975 | Sumner . | |
| 3,905,168 | 9/1975 | Nelmark et al. | 173/42 |
| 4,199,033 | 4/1980 | Van Gundy, Jr. | 173/43 |
| 4,311,347 | 1/1982 | Cobb | 173/44 |
| 4,684,360 | 8/1987 | Tokuno et al. | 83/499 |

FOREIGN PATENT DOCUMENTS

| | | |
|---|---|---|
| 2160682 | 6/1972 | Fed. Rep. of Germany . |
| 2156071 | 5/1973 | Fed. Rep. of Germany . |
| 2459344 | 7/1976 | Fed. Rep. of Germany . |
| 7807579 | 10/1978 | France . |
| 7734203 | 6/1979 | France . |

*Primary Examiner*—Frank T. Yost
*Assistant Examiner*—Scott A. Smith
*Attorney, Agent, or Firm*—Bierman and Muserlian

[57] ABSTRACT

Mounting for a swingable suspension of a cutter hammer to a boom or the like which is tiltable about a horizontal axis, with the cutter hammer being floatingly suspended and swingable transversely to the tilting plane about an axis which extends in the tilting plane of the boom, wherein the cutter hammer (2) is locked in the desired swinging position relative to the boom (1) by a form-fitting coupling (6, 7, 8, 9).

3 Claims, 2 Drawing Sheets

HAMMER-SWINGING MECHANISM

The invention refers to a mounting for a swingable suspension of a cutter hammer to a boom or the like which is tiltable about a horizontal axis, with the cutter hammer being floatingly suspended and swingable transversely to the tilting plane about an axis which extends in the tilting plane of the boom.

Conventional cutter hammers which are non-swingably mounted to the boom did not permit to dig an excavation of rectangular cross section because the lowering of the cutter hammer in a vertical plane allows to dig excavations of only trapezoid cross section due to the width of the cutter hammer unit which laterally exceeds to a considerable degree the actual cutter tool so that a rectilinear or vertical cutting of the ditch wall is not possible.

It was thus proposed in designs of the above-mentioned type to swingably mount the cutter hammer to the boom transversely to the tilting plane of the boom, with a hydraulic piston/cylinder unit performing the slanting and locking of the cutter hammer in this known design. However, these designs did not find practical application because the hydraulic piston/cylinder unit, which causes the swinging and locking of the cutter hammer, had to receive the blows exerted by the cutter hammer upon the subsoil in order to avoid a lateral deflection of the cutter hammer. These known designs were thus unsuitable for practical use.

The invention is based on the object to provide a mounting of the above-mentioned type such that it is completely suitable for practical application. This object is attained in accordance with the present invention by locking the cutter hammer in the desired swinging position relative to the boom through a form-fitting coupling. Thus, the enormous cutting forces are received by a form-fitting coupling, and by virtue of the form-fit, the deflection of the coupling is kept as low as possible. Such designs according to the invention are thus also suitable for suspension of heavy cutter hammers.

Advantageously, the form-fitting coupling can be achieved by a bolt which is received in aligned bores to thereby attain that the coupling can receive high forces since the bolts can be very accurately designed with regard to the bores. The bolt may be shiftable in axial direction by means of a hydraulic piston/cylinder unit so as to allow an automatic disengaging and engaging of the coupling. For receiving the bolt, the part supporting the piston/cylinder unit may be provided with guide bores within eyelets while the locking bores may be arranged in a swivel plate of the other part. Thus, a secure locking of the cutter hammer relative to the boom is obtained. The locking bores in the swivel plate may be arranged along a circular arc, with the center thereof lying on the axis of the swivel axis. Finally, the swivel plate may engage between the eyelets, with the free distance between the eyelets corresponding approximately to the width of the swivel plate so that the bolt is subjected only slightly to bending strain and primarily to shearing strain.

An exemplified embodiment of the subject matter of the invention is illustrated in the drawing.

FIG. 1 schematically shows a ditch excavation with a conventionally suspended cutter hammer.

FIG. 2 schematically depicts the ditch excavation with a cutter hammer suspended in accordance with the present invention.

Figure 1:
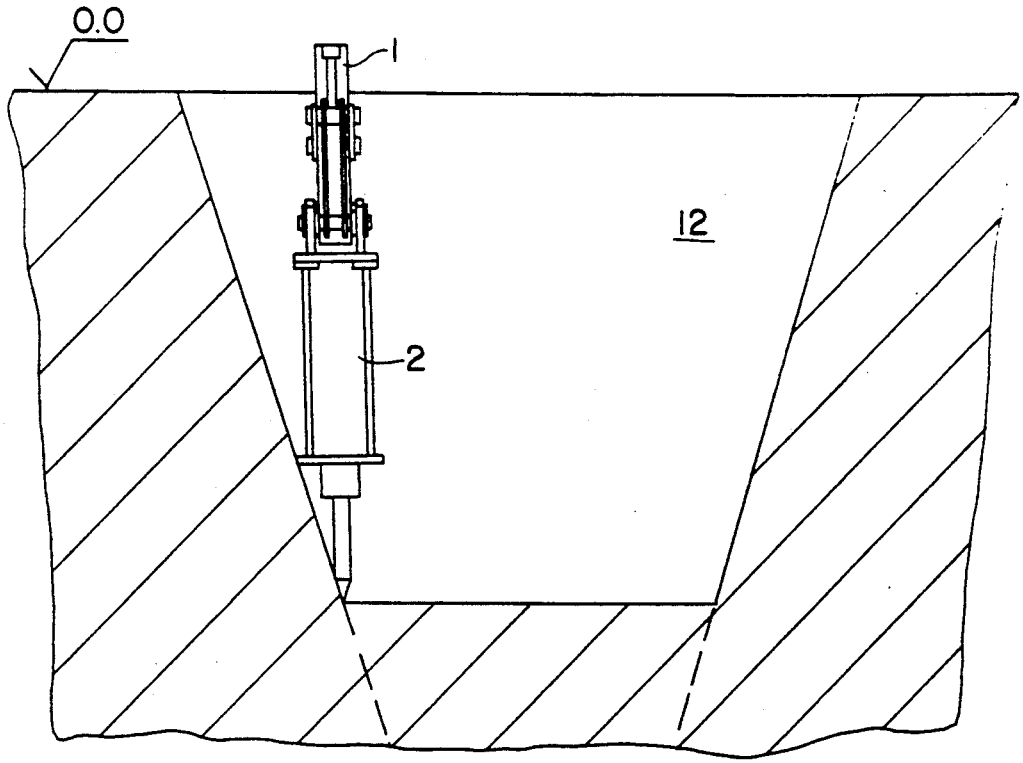

FIG. 1 shows the cutter hammer 2 articulated to the boom 1 in conventional manner which allows a change in the swinging position of the cutter hammer only in direction of the tilting movement upon tilting of the boom 1 but not transversely to the tilting plane. As can be seen from FIG. 1, the ditch has a trapezoid cross section, resulting in an increased rise of material to be removed. Furthermore, a larger amount of exchange material must be returned when filling the ditch.

Figure 2:
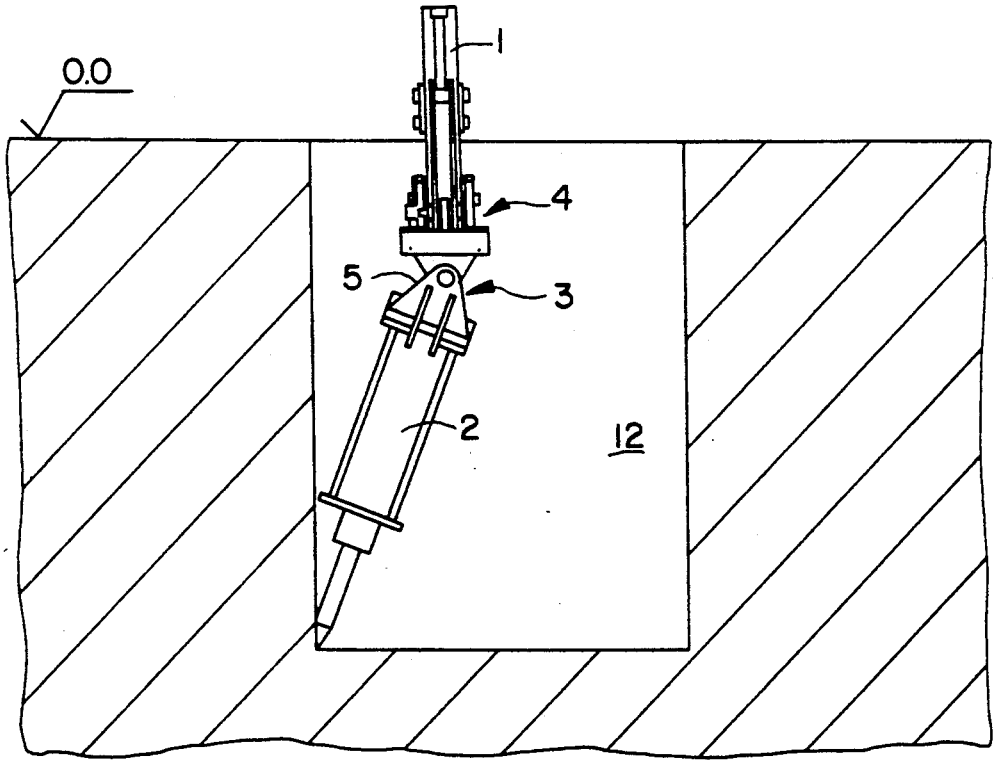

FIG. 2 shows the connection of the cutter hammer 2 with the boom via a swinging device 3 which is mounted in a quick change attachment 4 in the present exemplified embodiment. The swinging device 3 defines a swivel axis 5 which extends in the tilting plane of the boom 1 and about which the cutter hammer 2 is swingable relative to the tilting plane of the boom 1. The cutter hammer 2 is locked relative to the boom 1 by means of a form-fitting coupling unit which includes a bolt 6 extending parallel to the swivel axis 5, two eyelets 7 and 8, and a swivel plate 9. The eyelets 7 and 8 are provided with aligned guide bores, and the swivel plate 9 includes locking bores 10. The bolt 6 is shiftable in axial direction by a hydraulic piston/cylinder unit 11.

Figure 3:
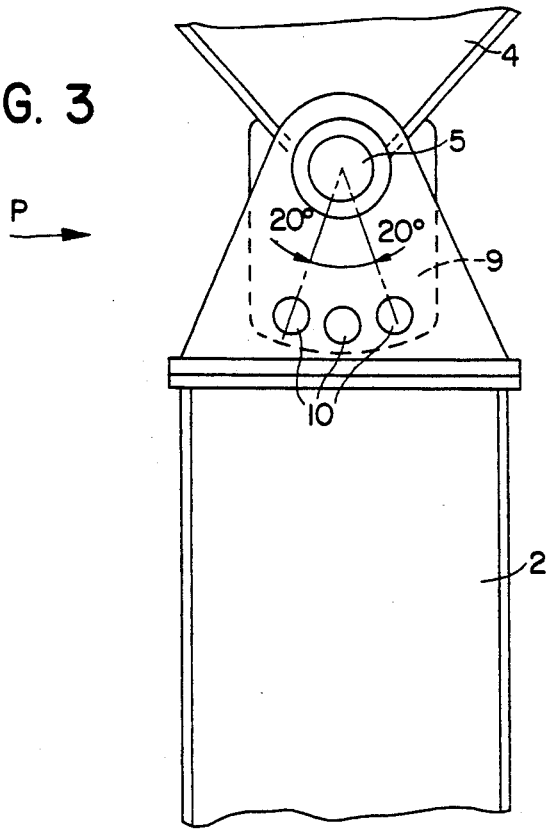
FIG. 3 is a detailed illustration of the swinging unit.
Figure 4:
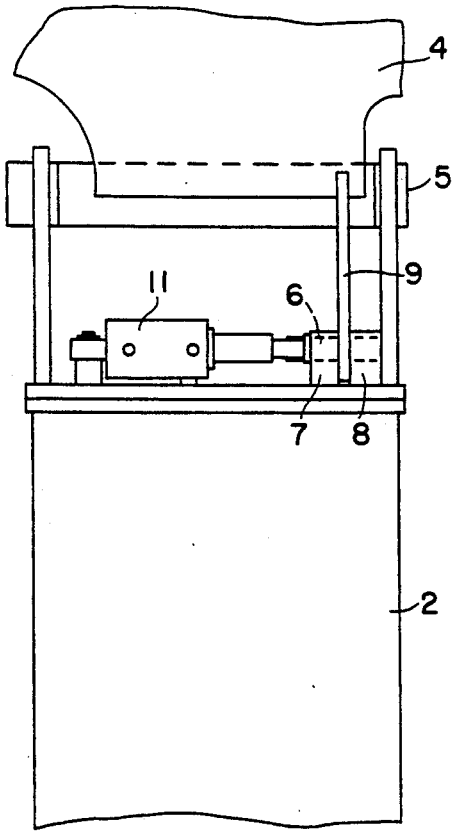
FIG. 4 shows a side view in direction of arrow P in FIG. 3.

As can be seen from FIG. 3, the locking bores 10 are arranged along a circular arc, with the center thereof lying in the longitudinal axis of the swivel axis 5. In the present embodiment, the central locking bore is arranged in such a manner that the cutter hammer 2 extends vertically relative to the quick change attachment 4. The remaining locking bores are offset relative to the vertical by about 20°. This angle corresponds approximately to the angle of inclination of the cutter hammer which angle of inclination is necessary in order to allow cutting of the side walls of the excavation 12 in approximately vertical manner.

When desiring to work the side wall by means of the cutter hammer 2, the cutter hammer 2 is placed with the tip upon the ground and the bolt 6 is withdrawn from the guide bore in the eyelet 8 and the locking bore 10 of the swivel plate 9 by means of the hydraulic piston/cylinder unit 11. Subsequently, the boom 1 is turned so as to swing the cutter hammer 2 relative to the boom 1 about the swivel axis 5 until the desired locking bore 10 is in alignment with the guide bores in the eyelets 7 and 8. Then, the hydraulic piston/cylinder unit inserts the bolt 6 which is maintained in this locking position by the piston/cylinder unit. Actuation of the piston/cylinder unit 11 can be done in usual manner from the control cabin of the excavator. Thus, the swinging of the cutter hammer 2 relative to the boom 1 does not require any additional operating personnel, rather the swinging may be carried out by the excavator operator himself from the control cabin.

I claim:

1. Mounting for a swingable suspension of a cutter hammer to a boom of an excavator which is floatingly suspended and swingable transversely to the tilting plane about an axis which extends in the tilting plane of the boom, characterized in that the cutter hammer (2) is locked in the desired swinging position relative to the boom (1) by a form-fitting coupling (6, 7, 8, 9) comprising a bolt (6) shiftable in an axial direction of the bolt by a hydraulic piston/cylinder unit mounted on the cutter hammer, said bolt extending through guide bores within eyelets on the cutter hammer, a swivel plate mounted to the boom and extending between the eyelets, said swivel plate having locking bores for selectively receiving the bolt to lock the cutter hammer in a desired angular position relative to the boom.

2. Mounting according to claim 1, characterized in that the locking bores (10) are arranged in the swivel plate (9) along a circular arc, with the center thereof lying on the axis of the swivel axis (5).

3. Mounting according to claim 1 or 2, characterized in that the swivel plate (9) engages between the eyelets (7, 8) wherein the free distance between the eyelets (7, 8) corresponds approximately to the width of the swivel plate (9).

* * * * *